US011946210B2

(12) United States Patent
Bernardi

(10) Patent No.: US 11,946,210 B2
(45) Date of Patent: Apr. 2, 2024

(54) DRIVEWAY REFLECTOR HOLDER AND TOOL FOR INSTALLING

(71) Applicant: William P. Bernardi, Ligonier, PA (US)

(72) Inventor: William P. Bernardi, Ligonier, PA (US)

( * ) Notice: Subject to any disclaimer, the term of this patent is extended or adjusted under 35 U.S.C. 154(b) by 537 days.

(21) Appl. No.: 17/222,223

(22) Filed: Apr. 5, 2021

(65) Prior Publication Data

US 2021/0310204 A1 Oct. 7, 2021

Related U.S. Application Data

(60) Provisional application No. 63/127,491, filed on Dec. 18, 2020, provisional application No. 63/005,682, filed on Apr. 6, 2020.

(51) Int. Cl.
*E01C 23/18* (2006.01)
*E01F 9/553* (2016.01)

(52) U.S. Cl.
CPC ..... *E01C 23/18* (2013.01); *E01F 9/553* (2016.02)

(58) Field of Classification Search
CPC ..... E01C 23/18; E01C 23/16; E01F 9/553; E01F 9/559; E01F 9/565; E01F 9/524; E01F 9/571; E01F 9/623; E01F 9/627; E01F 9/50; E01F 9/512; E01F 9/60; E01F 9/608
See application file for complete search history.

(56) References Cited

U.S. PATENT DOCUMENTS 1,771,892 A * 7/1930 Kilborn ..... E01F 9/553 404/15
1,798,467 A * 3/1931 Hartzler ..... E01F 9/553 404/15
1,803,635 A * 5/1931 George ..... E01F 9/553 D10/113.1
1,804,281 A * 5/1931 Shunk ..... E01F 9/553 404/15
2,779,240 A * 1/1957 Gaydos ..... E01F 9/608 359/542
3,916,815 A 11/1975 Valley
4,343,567 A 8/1982 Sarver et al.
4,625,473 A * 12/1986 Peterson ..... G01C 15/04 52/103
4,662,305 A * 5/1987 Cline ..... G09F 7/20 116/173

(Continued)

*Primary Examiner* — Abigail A Risic
(74) *Attorney, Agent, or Firm* — The Webb Law Firm

(57) ABSTRACT

A driveway reflector holder and installation tool assembly includes a reflector holder and an installation tool removably receivable in the reflector holder. The reflector holder includes a hollow sleeve body, a washer disposed on an upper end of the hollow sleeve body, and at least one retention feature disposed on the hollow sleeve body. The installation tool includes an elongated body, a head, and a tapered tip. The installation tool is configured to extend through the hollow sleeve body of the reflector holder with the head being positioned above the upper end of the hollow sleeve body and the tapered tip being positioned below the lower end of the hollow sleeve body. The installation tool is configured to be driven to insert the at least one reflector holder into a ground surface and then be removed from the at least one reflector holder.

20 Claims, 8 Drawing Sheets

(56) References Cited

U.S. PATENT DOCUMENTS

| | | | | |
|---|---|---|---|---|
| 4,977,851 | A | 12/1990 | Anderson | |
| 5,165,663 | A * | 11/1992 | Wells | E04H 12/2269 52/165 |
| 7,003,919 | B2 * | 2/2006 | Riker | H01B 1/24 52/298 |
| 7,249,910 | B2 | 7/2007 | Eckert et al. | |
| 8,251,626 | B1 * | 8/2012 | Gonzalez | F16B 21/086 411/509 |
| 10,669,735 | B2 * | 6/2020 | Johnson | E01F 9/608 |
| 2012/0110930 | A1 * | 5/2012 | Tate | A45F 3/44 52/741.15 |
| 2015/0096260 | A1 * | 4/2015 | Intagliata | E02D 27/42 52/741.15 |
| 2019/0063104 | A1 * | 2/2019 | Johnson | E01F 9/608 |
| 2020/0384339 | A1 * | 12/2020 | Fernandez | A63B 71/0054 |

* cited by examiner

DRIVEWAY REFLECTOR HOLDER AND TOOL FOR INSTALLING

CROSS REFERENCE TO RELATED APPLICATIONS

This application claims priority to U.S. Provisional Application Ser. No. 63/005,682, titled "Driveway Reflector Holder and Tool for Installing" and filed on Apr. 6, 2020, and U.S. Provisional Application Ser. No. 63/127,491, titled "Driveway Reflector Holder and Tool for Installing" and filed on Dec. 18, 2020, the disclosures of which are hereby incorporated by reference in their entireties.

BACKGROUND OF THE INVENTION

Field of the Invention

The present invention relates generally to a holder for retaining a reflector in a ground surface along a driveway or roadside and an installation tool for the holder and, more particularly, to a reflector holder having a hollow sleeve body for removably receiving the installation tool therein

Description of Related Art

Driveway reflectors or markers are commonly available in the form of flexible fiberglass, plastic, or metal rods with reflective material in the form of tape or two or more plastic reflectors disposed on the rod. These rods are usually either ¼" or 5/16" in diameter. The rods can be penetrated into the ground at the edge of a driveway or other suitable locations for marking purposes; for example, to assist a driver of a vehicle in locating the driveway edge while navigating a vehicle into or out of the driveway.

These flexible rods can only be driven into soft dirt or snow. These markers are usually located in the grass close to the edge of the paved or gravel driveway edge, which can make it difficult for grass cutting in the summer and can require reinstallation.

When a rigid shaft is used that allows the shaft to be directly driven into the ground, that same rigidity poses a damage risk to vehicles that might strike the device. A number of rigid marker devices have been developed that possess sufficient column strength to be driven into the ground.

Other reflectors have been disclosed in the art which have short sleeves with flattened or pointed closed ends that are driven into the ground to allow insertion and removal of the poles. These types of devices do not allow snow melt or rain water to drain, which may cause freeze splitting and deterioration of the pole ends. In addition, in the summer when the poles are removed for grass cutting and are not immediately replaced, the sleeves can be very difficult to find within the grass.

The prior art shows various types of roadway markers with a separate closed end sleeve driven into the ground having an inside diameter large enough to allow insertion of the reflector marker, such as U.S. Pat. No. 4,977,851 to Anderson and U.S. Pat. No. 4,343,567 to Sarver and Arthur.

Similarly, U.S. Pat. No. 5,165,663 to Wells, the disclosure of which is hereby incorporated herein by reference in its entirety, discloses a fence post anchor having a hollow plastic sleeve attached to a closed pointed end and uses a flat-ended metal driver tool inserted in the sleeve to drive the sleeve into the ground by directing the force to the solid closed bottom instead of the sleeve, such that the sleeve is not damaged.

Still other prior art devices are provided with open-ended sleeves, which require the hole to be drilled or cement to be poured around the sleeve, such as U.S. Pat. No. 3,916,815 to Valley and U.S. Pat. No. 7,249,910 to Eckert and Thompson.

SUMMARY OF THE INVENTION

According to one aspect or embodiment of the present disclosure, a driveway reflector holder and installation tool assembly may include at least one reflector holder including a hollow sleeve body extending from an upper end to a lower end, a washer disposed proximate to the upper end of the hollow sleeve body, and at least one retention feature disposed on an exterior of the hollow sleeve body; and an installation tool removably receivable within the hollow sleeve body of the at least one reflector holder, including an elongated body extending from an upper end to a lower end, a head defined at the upper end of the elongated body, and a tapered tip defined at the lower end of the elongated body. The installation tool may be configured to extend through the hollow sleeve body of the at least one reflector holder with the head being positioned above the upper end of the hollow sleeve body and the tapered tip being positioned below the lower end of the hollow sleeve body. The installation tool may be configured to be driven to insert the at least one reflector holder into a ground surface and configured to be removed from the at least one reflector holder after the at least one reflector holder has been driven into the ground surface. The at least one reflector holder may be configured to removably receive a driveway reflector in the hollow sleeve body after the installation tool is removed.

In some embodiments or aspects, the installation tool may define a radiused corner configured to engage the upper end of the hollow sleeve body. The elongated body of the installation tool may include a centering surface proximate to the radiused corner having a diameter configured to center the installation tool within the hollow sleeve body of the at least one reflector holder. The elongated body of the installation tool may include a blocking surface proximate to the tapered tip, the blocking surface having a diameter corresponding to an inner diameter of the hollow sleeve, whereby the blocking surface is configured to prevent dirt from entering the hollow sleeve.

In some embodiments or aspects, the elongated body of the installation tool may include a relief surface extending from the centering surface to the blocking surface. The head of the installation tool may include a hole configured to receive a removal pin or a removal wire therethrough, the removal pin or the removal wire each being configured to facilitate removal of the installation tool from the at least one reflector holder. The hollow sleeve body of the at least one reflector holder may include a thin-walled extension extending beyond the washer at the upper end. The thin-walled extension may be configured to be hammered over the washer and fasten the washer to the hollow sleeve body upon driving the installation tool and the at least one reflector holder into the ground.

In some embodiments or aspects, the hollow sleeve body of the reflector holder may include at least one circular groove extending about an outer circumference of the hollow sleeve body proximate the upper end. The washer may include a body defining a central hole corresponding to an outer circumference of the at least one circular groove of the hollow sleeve body, a plurality of slits extending through the body and radially outward from the central hole and defining a plurality of fingers, and a ring extending about an outer circumference of the washer. The plurality of fingers of the washer may be configured to engage with the at least one circular groove of the at least one reflector holder. The plurality of slits may terminate in a plurality of holes extending through the body of the washer. The plurality of fingers may include rounded lower edges at ends nearest the central hole of the washer body. The at least one circular groove may be at least partially defined by an upper corner.

In some embodiments or aspects, the at least one reflector holder may include a tapered upper surface opposite the upper corner of the at least one circular groove in the direction of the upper end, the tapered upper surface configured to engage with rounded lower edges of the plurality of fingers when applying the washer to the at least one reflector holder, the plurality of fingers being configured to flex upwardly as the washer is fitted over the tapered upper surface until the plurality of fingers become engaged with the at least one circular groove. The plurality of fingers may include squared upper edges corresponding to the upper corner of the at least one circular groove. The squared upper edges may be configured to at least partially abut the upper corner. A lower surface of the ring of the washer may be configured to engage with the ground surface upon the installation tool driving the at least one reflector holder into the ground surface. The lower surface of the ring of the washer may protrude downwardly with respect to the body of the washer. The body of the washer may be dome shaped.

In some embodiments or aspects, a driveway reflector holder may include a first end configured to extend at least partially into a ground surface; a second end, opposite the first end; a body extending between the first end and the second end, the elongated sleeve defining a hollow sleeve; at least one retention feature disposed on an outer surface of the body; and a washer extending radially outward from an outer circumference of the body proximate the second end. The hollow sleeve may be configured to removably receive an installation tool therein, and upon installation of the driveway reflector holder, the hollow sleeve is configured to removably receive a driveway reflector therein. The second end may be configured to retain the washer about the body.

In some embodiments or aspects, the washer may include a dome-shaped body defining a central hole corresponding to the outer circumference of the body; a plurality of slits extending through the body and radially outward from the central hole, the plurality of slits defining a plurality of fingers; and a ring extending about an outer circumference of the washer. A lower surface of the ring of the washer may be adapted to engage with the ground surface and, upon engagement, resist displacement forces caused by the ground.

In some embodiments or aspects, the present disclosure may be characterized by one or more of the following numbered clauses:

Clause 1. A driveway reflector holder and installation tool assembly, comprising: at least one reflector holder, the reflector holder comprising a hollow sleeve body extending from an upper end to a lower end, a washer disposed proximate to the upper end of the hollow sleeve body, and at least one retention feature disposed on an exterior of the hollow sleeve body; and an installation tool removably receivable within the hollow sleeve body of the at least one reflector holder, the installation tool comprising an elongated body extending from an upper end to a lower end, a head defined at the upper end of the elongated body, and a tapered tip defined at the lower end of the elongated body, wherein the installation tool is configured to extend through the hollow sleeve body of the at least one reflector holder with the head being positioned above the upper end of the hollow sleeve body and the tapered tip being positioned below the lower end of the hollow sleeve body, wherein the installation tool is configured to be driven to insert the at least one reflector holder into a ground surface and configured to be removed from the at least one reflector holder after the at least one reflector holder has been driven into the ground surface, and wherein the at least one reflector holder is configured to removably receive a driveway reflector in the hollow sleeve body after the installation tool is removed.

Clause 2. The driveway reflector holder of clause 1, wherein the installation tool defines a radiused corner configured to engage the upper end of the hollow sleeve body.

Clause 3. The driveway reflector holder of clause 1 or 2, wherein the radiused corner is located proximate to a bottom surface of the head of the installation tool.

Clause 4. The driveway reflector holder any of clauses 1-3, wherein wherein the elongated body of the installation tool comprises a centering surface proximate to the radiused corner, the centering surface having a diameter configured to center the installation tool within the hollow sleeve body of the at least one reflector holder.

Clause 5. The driveway reflector holder any of clauses 1-4, wherein the elongated body of the installation tool comprises a blocking surface proximate to the tapered tip, the blocking surface having a diameter corresponding to an inner diameter of the hollow sleeve, whereby the blocking surface is configured to prevent dirt from entering the hollow sleeve.

Clause 6. The driveway reflector holder any of clauses 1-5, wherein the elongated body of the installation tool comprises a relief surface extending from the centering surface to the blocking surface.

Clause 7. The driveway reflector holder any of clauses 1-6, wherein the head of the installation tool comprises a hole configured to receive a removal pin or a removal wire therethrough, the removal pin or the removal wire each being configured to facilitate removal of the installation tool from the at least one reflector holder.

Clause 8. The driveway reflector holder any of clauses 1-7, wherein the hollow sleeve body of the at least one reflector holder comprises a thin-walled extension extending beyond the washer at the upper end, wherein the thin-walled extension is configured hammered over the washer and fasten the washer to the hollow sleeve body upon driving the installation tool and the at least one reflector holder into the ground.

Clause 9. The driveway reflector holder any of clauses 1-8, wherein the hollow sleeve body of the reflector holder comprises at least one circular groove extending about an outer circumference of the hollow sleeve body proximate the upper end, wherein the washer comprises a body defining a central hole corresponding to an outer circumference of the at least one circular groove of the hollow sleeve body, a plurality of slits extending through the body and radially outward from the central hole and defining a plurality of fingers, and a ring extending about an outer circumference of the washer, and wherein the plurality of fingers of the washer are configured to engage with the at least one circular groove of the at least one reflector holder.

Clause 10. The driveway reflector holder any of clauses 1-9, wherein the plurality of slits terminate in a plurality of holes extending through the body of the washer.

Clause 11. The driveway reflector holder any of clauses 1-10, wherein the plurality of fingers comprise rounded lower edges at ends nearest the central hole of the washer body.

Clause 12. The driveway reflector holder any of clauses 1-11, wherein the at least one circular groove is at least partially defined by an upper corner.

Clause 13. The driveway reflector holder any of clauses 1-12, wherein the at least one reflector holder comprises a tapered upper surface opposite the upper corner of the at least one circular groove in the direction of the upper end, the tapered upper surface configured to engage with rounded lower edges of the plurality of fingers when applying the washer to the at least one reflector holder, the plurality of fingers being configured to flex upwardly as the washer is fitted over the tapered upper surface until the plurality of fingers become engaged with the at least one circular groove.

Clause 14. The driveway reflector holder any of clauses 1-13, wherein the plurality of fingers further comprise squared upper edges corresponding to the upper corner of the at least one circular groove, the squared upper edges being configured to at least partially abut the upper corner.

Clause 15. The driveway reflector holder any of clauses 1-14, wherein a lower surface of the ring of the washer is configured to engage with the ground surface upon the installation tool driving the at least one reflector holder into the ground surface.

Clause 16. The driveway reflector holder any of clauses 1-15, wherein the lower surface of the ring of the washer protrudes downwardly with respect to the body of the washer.

Clause 17. The driveway reflector holder any of clauses 1-16, wherein the body of the washer is dome shaped.

Clause 18. A driveway reflector holder comprising: a first end configured to extend at least partially into a ground surface; a second end, opposite the first end; a body extending between the first end and the second end, the elongated sleeve defining a hollow sleeve; at least one retention feature disposed on an outer surface of the body; and a washer extending radially outward from an outer circumference of the body proximate the second end, wherein the hollow sleeve is configured to removably receive an installation tool therein, and upon installation of the driveway reflector holder, the hollow sleeve is configured to removably receive a driveway reflector therein, wherein the second end is configured to retain the washer about the body.

Clause 19. The driveway reflector holder of clause 18, wherein the washer comprises: a dome-shaped body defining a central hole corresponding to the outer circumference of the body; a plurality of slits extending through the body and radially outward from the central hole, the plurality of slits defining a plurality of fingers; and a ring extending about an outer circumference of the washer, and wherein the plurality of fingers of the washer are configured to engage with at least one circular groove extending about the outer circumference of the body.

Clause 20. The driveway reflector holder of clause 18 or 19, wherein a lower surface of the ring of the washer is adapted to engage with the ground surface and upon engagement, resist displacement forces caused by the ground.

These and other features and characteristics of the present invention, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular forms of "a", "an", and "the" include plural referents unless the context clearly dictates otherwise.

DETAILED DESCRIPTION OF THE INVENTION

Figure 1:
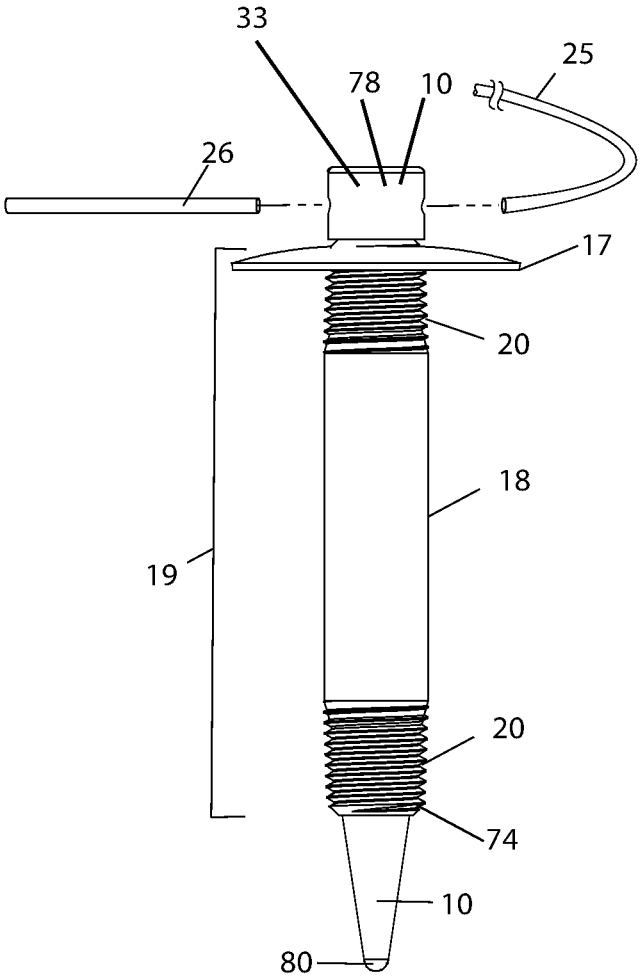
FIG. 1 is a side view of an assembled reflector holder and installation tool according to an example of the present disclosure.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. For example, the term "lower" relates to a portion of the apparatus described below that, when in use, is located at a point farther in the ground than other portions of the apparatus. The term "upper" relates to a portion of the apparatus that, when in use, is either located above the ground or higher up within the ground than other portions of the apparatus. However, it is to be understood that the invention may assume various alternative variations and step sequences, except where expressly specified to the contrary. It is also to be understood that the specific devices and processes illustrated in the attached drawings and described in the following specification are simply exemplary embodiments or aspects of the invention. Hence, specific dimensions and other physical characteristics related to the embodiments or aspects disclosed herein are not to be considered as limiting. The term "at least" is synonymous with "greater than or equal to".

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

The term "includes" is synonymous with "comprises".

Figure 2:
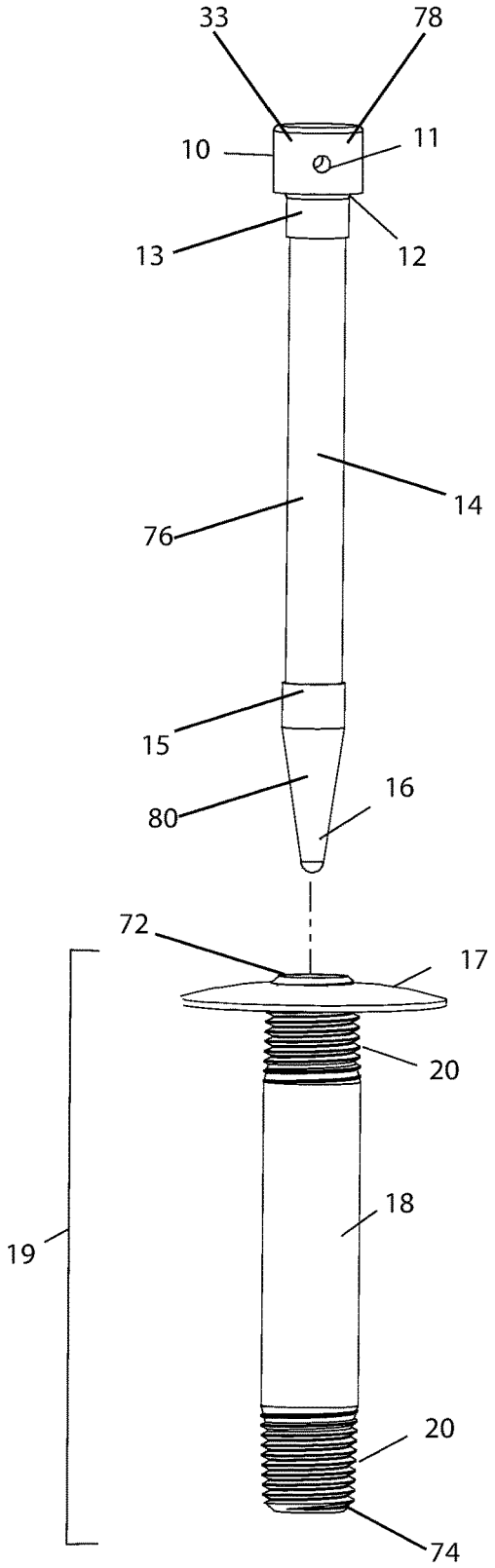
FIG. 2 is an exploded side view of the reflector holder and installation tool of FIG. 1.
Figure 3:
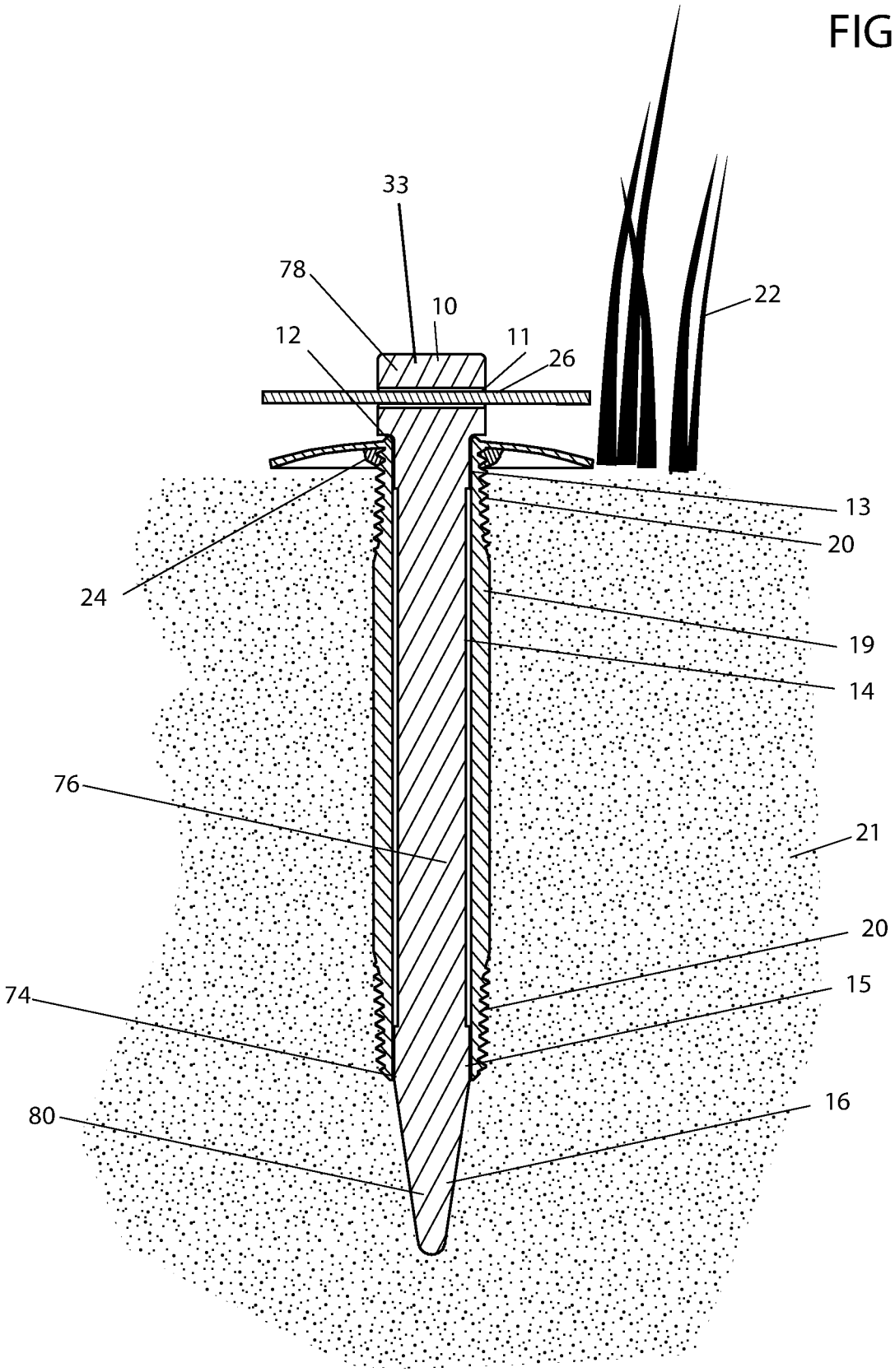
FIG. 3 is a cross-sectional view of the reflector holder and installation tool of FIG. 1 disposed in a ground surface.

With reference to FIGS. 1-3, an assembly of at least one driveway reflector holder 19 and an installation tool 10 for inserting the reflector holder 19 into a ground surface 21 is shown in accordance with one embodiment or aspect of the present disclosure. The reflector holder 19 includes a hollow sleeve body 18 extending from an upper end 72 to a lower end 74, a washer 17 disposed proximate the upper end 72, and at least one retention feature 20 disposed on an exterior of the hollow sleeve body 18. According to an example, both the upper end 72 and lower end 74 of the hollow sleeve body 18 are open. The installation tool 10 may be in the form of a driver stake 10 that may be removably receivable within the hollow sleeve body 18 of the reflector holder 19. The installation tool 10 includes an elongated body 76 extending from an upper end 78 to a lower end 80. A head 33 is defined at the upper end 78 of the elongated body 76, and a tapered or pointed tip 16 is defined at the lower end 80 of the elongated body 76.

As shown, the installation tool 10 is configured to extend through the hollow sleeve body 18 of the reflector holder 19 with the head 33 being positioned above the upper end 72 of the hollow sleeve body 18 and the tapered tip 16 being positioned below the lower end of the hollow sleeve body 18. The installation tool 10 is inserted into the hollow sleeve body 18 and then driven into the ground surface 21 to insert and affix the reflector holder 19 into the ground surface 21, as will be described in more detail below. Then the installation tool 10 is removed from the reflector holder 19 and the ground surface 21 after the reflector holder 19 has been inserted and affixed into the ground surface 21. The hollow sleeve body 18 of the at least one reflector holder 19 is then capable of removably receiving a driveway reflector 23 in the hollow sleeve body 18 after removal of the installation tool 10.

FIG. 1 illustrates the reflector holder 19 and driver stake/installation tool 10 in an assembled condition ready for installation. The driver stake 10 may be made from hard tough steel alloy, such as 4140 or 1045 carbon steel. It is contemplated that other materials suitable for insertion into the ground surface may also be used. The driver stake 10 is inserted into the welded reflector holder 19 with the tapered tip 16 protruding through the lower end of the hollow sleeve body 18. The reflector holder 19, which may be made from a stainless steel material, includes the corrosion-resistant hollow sleeve or pipe body 18 and the wide formed, corrosion-resistant washer 17, which is attached to the hollow sleeve body 18 by an attachment weld 24 (shown in FIG. 3). The high-strength driver stake 10 solidly engages metal-to-metal with the welded reflector holder 19 and extends through the reflector holder 19 to pierce the ground surface 21.

The hollow sleeve body 18 includes retention features 20 in the form of pipe threads defined at or adjacent to each of the upper and lower ends of the hollow sleeve body 18. The pipe threads 20 grip the ground surface 21 to retain the reflector holder 19 within the ground. The pipe threads 20 also make removal of the driver stake 10 from the reflector holder 19 easier by preventing backout of the reflector holder 19 during removal of the driver stake 10. While the retention features 20 shown in FIGS. 1-3 are pipe threads, it is contemplated and will be described below that other retention features may be used.

A removal pin 26 and/or a removal wire 25 may be provided to facilitate removal of the driver stake 10 from the reflector holder 19. As shown in FIGS. 2 and 3, a hole 11 is defined in the head 33 of the driver stake 10 to receive the removal pin or removal wire 25 therethrough. Before or after the driver stake 10 is inserted into the ground, the removal pin 26 may be inserted through the hole 11. The removal pin 26 provides an easily accessible surface for a user to grab and pull, resulting in removal of the driver stake 10 from the hollow sleeve body 18. The removal wire 25 provides this same benefit, but may form a continuous loop around the hole 11, allowing a user to hook one or more of their fingers around the removal wire 25 in order to apply the necessary force to remove the driver stake 10 from the hollow sleeve body 18. A tool (not shown) may also be used to grasp the removal wire 25 to facilitate removal of the driver stake 10. It is contemplated that both the removal pin 26 and the removal wire 25 may be permanently affixed to the hole 11 and head 33 of the driver stake 10 to always provide an element that helps facilitate removal of the driver stake 10 as just described. Both the removal pin 26 and the removal wire 25 may also be made of a steel, plastic, or otherwise durable material known to those having skill in the art in order to allow the driver stake 10 to be repeatedly used.

FIG. 2 illustrates an exploded view of the assembly. A radiused corner 12 is defined under the head 33 of the driver stake 10 that prevents the softer hollow sleeve body 18 from binding on the driver stake 10 as the driver stake 10 is driven into the ground surface 21. The radiused corner 12 will contact the hollow sleeve body 18 when the driver stake 10 is driven into the ground. This will force the inner diameter of the hollow sleeve body 18 to roll outward in order to prevent this binding form occurring. The radiused corner 12 may be sized relative to the inner diameter of the hollow sleeve body 18 in order to facilitate the outward rolling of the hollow sleeve body 18 during use. In other words, the radiused corner 12 may be of a size that, during use of the driving stake 10, receives the hollow sleeve body 18 within the radius of the corner in order to roll the hollow sleeve body 18 outward in a direction away from a central axis (not shown) of the driver stake 10 or the reflector holder 19.

A close-tolerance slip fit outer diameter 13 is defined on the elongated body 76 of the driver stake 10 to keep the reflector holder 19 centered on the driver stake 10 but loose enough for ease of removal. The size of the close-tolerance slip fit outer diameter 13 corresponds to the inner diameter of the hollow sleeve body 18. As the name would suggest, the tolerance formed between the outer diameter 13 and the inner diameter of the hollow sleeve body 18 must be close enough to force the driver stake 10 be centered within the hollow sleeve body 18, but large enough so that any frictional forces potentially acting between the outer diameter and the hollow sleeve body 18 do not impede the removal of the driver stake 10 from the hollow sleeve body 18.

The elongated body 76 of the driver stake 10 also includes a relief surface 14, which is undersized relative to at least the close-tolerance slip fit outer diameter 13. The relief surface 14 comprises most of the length of the elongated body 76 and provides a clearance between the driver stake 10 and the interior of the hollow sleeve body 18 so as to reduce or prevent frictional forces that may hinder or prevent removal of the driver stake 10 as it is withdrawn from the hollow sleeve body 18 of the reflector holder 19. This can be seen as a gap extending between the elongated body 76 and the hollow sleeve body 18 along the length of the relief surface 14 in FIG. 3. The relief surface 14 may be located lower than the close-tolerance slip fit outer diameter 13 and the radiused corner 12.

The elongated body 76 of the driver stake 10 includes a tight-fitting outer diameter surface 15 that prevents or limits dirt from entering between the driver stake 10 and the hollow sleeve body 18 and binding or clogging between the elongated body 76 and the hollow sleeve body 18. This may interfere with removal of the driver stake 18 from the reflector holder 19. The tight-fitting outer diameter surface 15 has a diameter that creates a closer tolerance with respect to the inner diameter of the hollow sleeve body 18 than the relief surface 14. The tight-fitting outer diameter surface 15 may have a diameter that is equal or greater than that of the close-tolerance slip fit outer diameter 13. The larger diameter of the tight-fitting outer diameter surface 15 pushes dirt away from the driver stake 10 during insertion into the ground surface 21 and is also shaped to block or prevent dirt from entering the hollow sleeve body 18, which would fill the tolerance formed by the smaller diameter of the relief surface 14 and the inner diameter of the hollow sleeve body 18.

The driver stake 10 includes the tapered tip 16 at the lower end. The tapered tip 16 is provided with a steep angle to facilitate penetration of the ground surface 21 and to provide a void 27 when removed from the reflector holder 19 to facilitate drainage through the reflector holder 19 and deepen the insertion length of the reflector. The angle of the taper on the tapered tip 16 may vary depending on the type of ground into which the driver stake 10 is being driven. For example, rockier ground may require a sharper taper in order for the driver stake 10 to drive the reflector holder 19 fully into the ground, whereas softer soil may only require a more rounded, or less sharp, taper.

FIG. 3 illustrates a sectional view of the assembly after being driven into the ground surface 21 with the washer 17 of the reflector holder 19 positioned flush with the ground surface 21 below the level of the grass 22. To install the reflector holder 19 in the ground surface 21, the driver stake 10 is inserted into the hollow sleeve body 18 with the tapered tip 16 extending from the lower end of the hollow sleeve body 18. The head 33 of the driver stake 10 is hammered (not shown) to drive the assembled driver stake 10 and reflector holder 19 into the ground surface 21. The tapered tip 16 defines and creates a hole in the ground surface 21 until the washer 17 is positioned flush with the ground surface 21. The removal pin 26 is then inserted into the hole 11 of the head 33 of the driver stake 10. The washer 17 may be formed to be easily visible under the level of the grass 22 when the reflector rod 23 is removed for grass cutting and landscaping to aid in replacement of the reflector rod 23 when completed.

Figure 4:
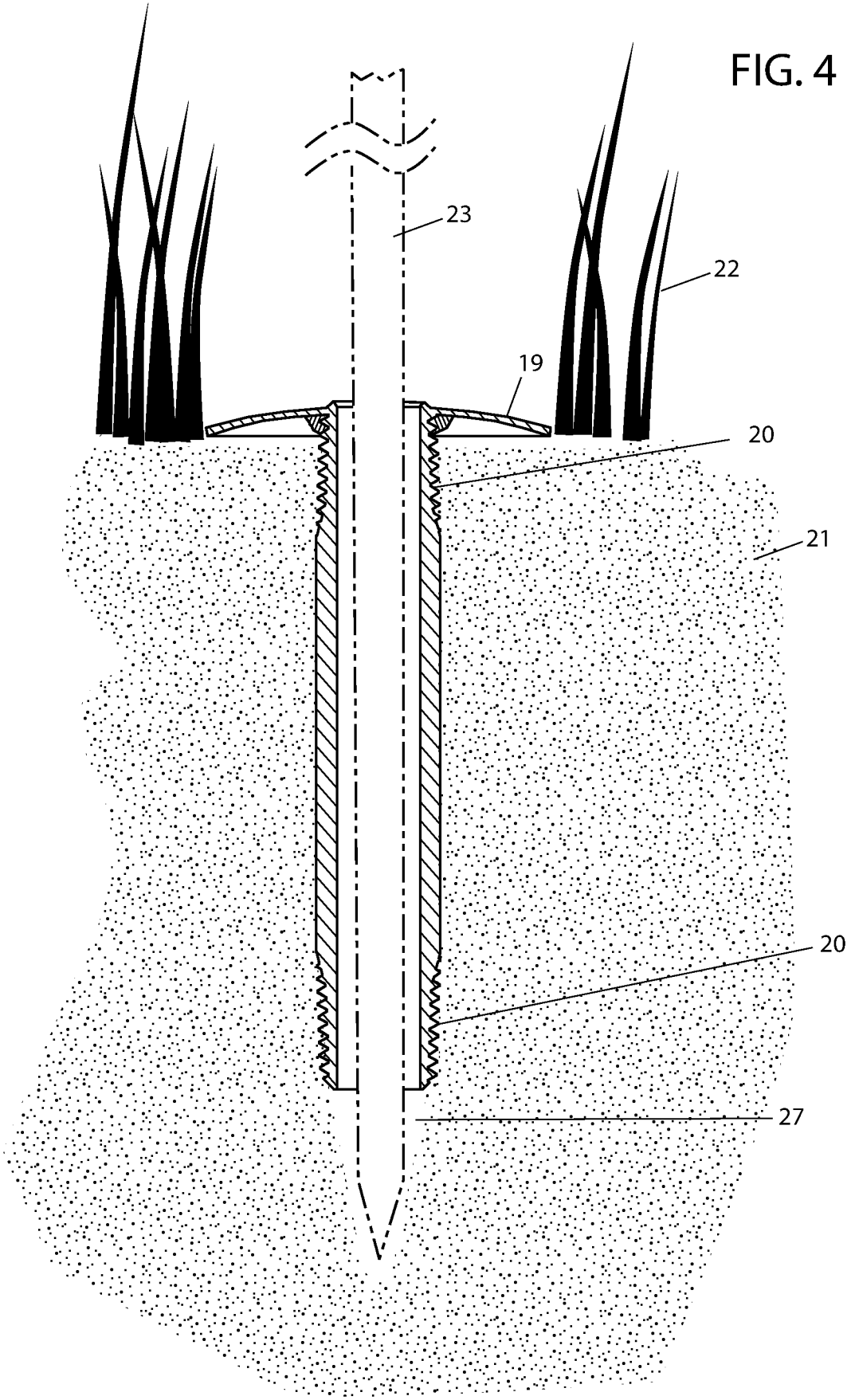
FIG. 4 is a cross-sectional view of the reflector holder of FIG. 1 disposed in the ground surface with the installation tool removed.

FIG. 4 illustrates the same sectional view of the reflector holder 19 installed in the ground surface 21 and the driver stake 10 removed from the reflector holder 19. The reflector holder 19 is embedded into the ground surface 21 below the level of the grass 22. A representative ¼" diameter driveway reflector rod 23, shown in phantom, is installed in the reflector holder 19 and extends below the lower end of the hollow sleeve body 18 into the driver stake pocket void cavity 27 left by the tapered tip 16 of the driver stake 10 after removal. The pipe threads 20 on the exterior of the hollow sleeve body 18 retain the reflector holder 19 in the ground surface 21.

Figure 5:
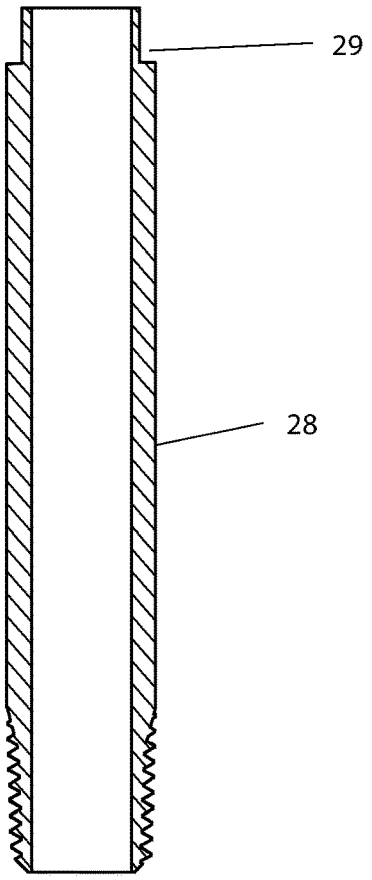
FIG. 5 is a cross-sectional view of a reflector holder according to another example of the present disclosure.
Figure 6:
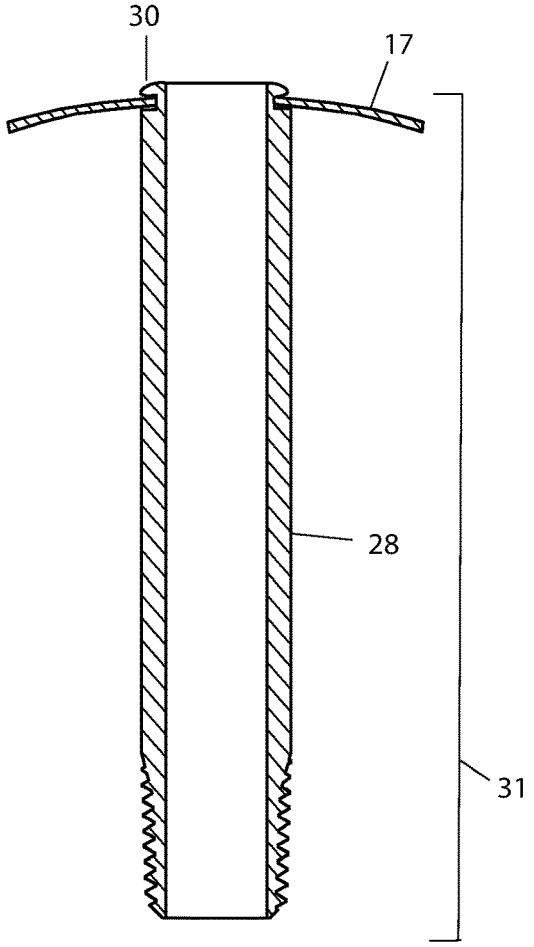
FIG. 6 is a cross-sectional view of the reflector holder of FIG. 5 with a washer disposed thereon.

FIGS. 5 and 6 illustrate sectional views of a reflector holder 31 having a hollow sleeve body 28 according to another example of the present disclosure. The top of the hollow sleeve body 28 is machined to form a thin-walled extension 29 configured to form a close fit through the inner diameter of the stainless steel washer 17 and to be upset by hammering over the washer 17 to firmly fasten the washer 17 to the hollow sleeve body 28 without welding. After being upset by hammering, the thin-walled extension 29 is deformed to define a flange 30 over the washer 17 to retain the washer 17 on the hollow sleeve body 28. It is contemplated that either hammering the head 33 of the driving stake 10 during the process of inserting the driving stake 10 and reflector holder 19 into the ground may be sufficient to fasten the washer 17 to the hollow sleeve body 28 or a user may be required to hammer the thin-walled extension 29 over the washer 17 before inserting the driving stake 10 into the reflector holder 19 for insertion into the ground surface 21.

Figure 7:
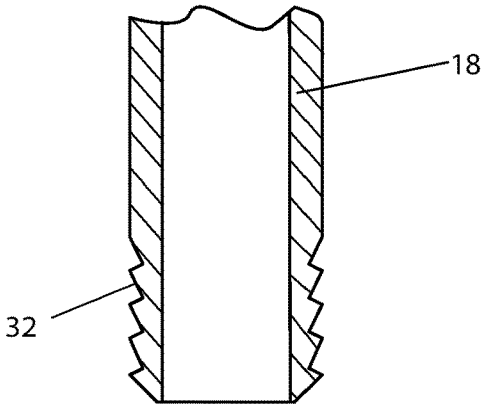
FIG. 7 is a cross-sectional view of a portion of a reflector holder according to an example of the present disclosure.

FIG. 7 illustrates a lower portion of a hollow sleeve body 18 of a reflector holder 19 according to another example of the present disclosure. The exterior of the hollow sleeve body 18 includes a retention feature in the form of coarser threads or grooves or a series of barb-shaped threads 32, which may also grip the soil of the ground surface 21 and retain the reflector holder 19 within the ground.

Figure 8:
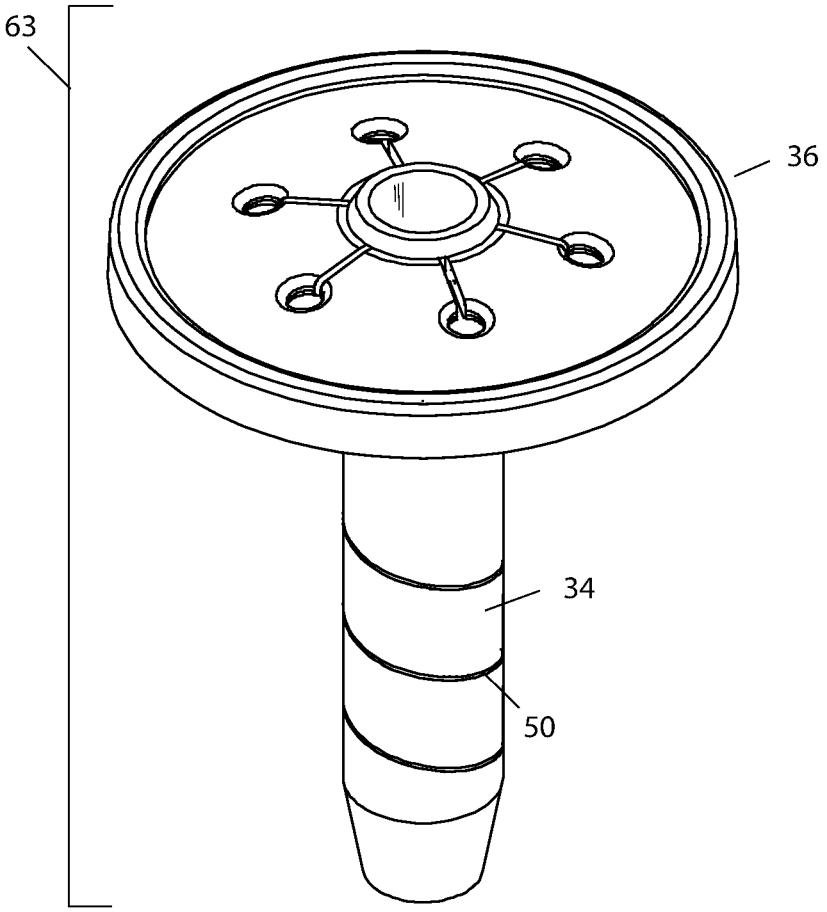
FIG. 8 is a side view of an assembled washer-holder assembly according to another example of the present disclosure.

FIG. 8 illustrates a washer and holder assembly 63 having a molded washer 36 assembled on a stainless-steel holder 34 according to another example of the present disclosure. In this example, the exterior of the hollow sleeve body of the holder 34 includes a retention feature in the form of a spiral groove 50 which may provide a better grip of the soil of the ground surface. While only one spiral groove 50 is shown, additional spiral grooves 50 may be included to increase the gripping characteristics of the assembly 63. It is also contemplated that the retention features 20, 32 previously described may be used.

Figure 9:
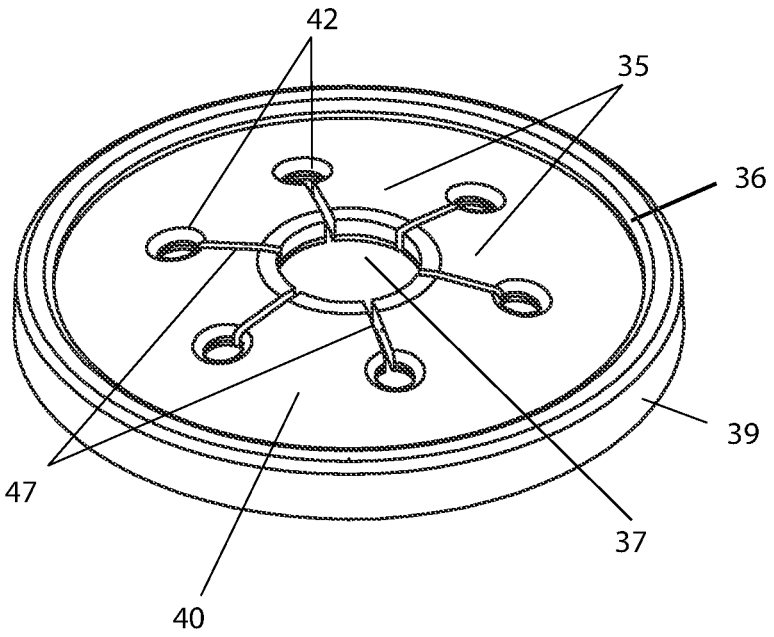
FIG. 9 is a perspective view of the washer of the washer-holder assembly of FIG. 8.

FIG. 9 illustrates the molded washer 36 which can be a polypropylene or another UV-resistant plastic compound. The molded washer 36 is injection molded to include a generally dome-shaped body 40 having six flexible fingers 35 (only two identified for clarity). The fingers 35 are defined by six slits 47 (only two identified for clarity). The fingers 35 and the slits 47 extend outwardly along the body 40 from an inner diameter of a center hole 37 of the washer 36. The slits 47 terminate into holes 42 (only two identified for clarity). Both the weld slits 47 and the holes 42 are formed through the molded washer 36 which permits the fingers 35 to flex and have a degree of resiliency during use that they otherwise would not have. The slits 47 and the holes 42 also provide stress relief to the molded washer 36 so that the plastic does not tear, crack, or otherwise deform when the fingers 35 flex or the molded washer 36 undergoes stress during use. As shown, the slits 47 are approximately 0.030 inches wide, and the holes 42 are approximately 0.125 inches in diameter; however, other appropriate sizing may be used depending on the size of the reflector to be held in the washer and holder assembly 63. The washer 36 also includes an outer ring 39 extending about the outer circumference of the washer 36. The outer ring 39 extends in the lower direction more so than any other element of the washer 36, the features of which will be discussed below.

Figure 10:
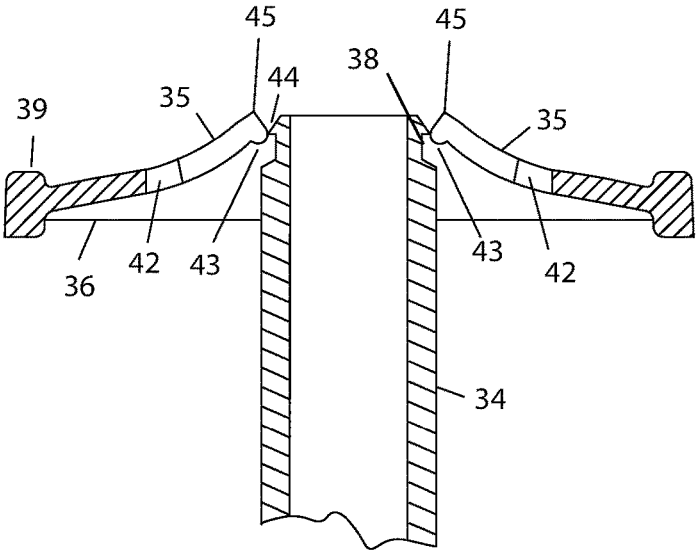
FIG. 10 is a cross-sectional view of the washer-holder assembly of FIG. 8.

FIG. 10 illustrates the molded washer 36 as it is being applied to the holder 34. The holder 34 includes a groove 38 that receives the ends or tips of the fingers 35 to affix the washer 36 to the holder 34. The fingers 35 are deflected upwardly before fitting into the groove 38 as the central hole 37 of the molded washer 36 is fit around the top of the holder 34. The top of the holder 34 includes a sharp upper tapered surface 44 to interact with the fingers 35 of the washer 36 and to facilitate the locking of the washer 36 about the holder 34. The groove 38 may be partially defined by an upper corner 46 on a side of the holder generally opposing the upper tapered surface 44 in the upward direction. The groove 38 may also be partially defined by a slanted bottom surface that extends toward the ground.

The tips of the fingers 35 include rounded lower edges 43 that permit the fingers 35 to roll over the sharp tapered upper surface 44. The contact between the rounded lower edges 43 and the upper surface 44 causes the fingers 35 to flex upwardly during assembly of the washer 36 and the holder 34. As the washer 36 is pushed downwardly and the lower edges 43 of the fingers flex against the upper surface 44 of the holder, the fingers 35 will eventually snap into the groove 38. The fingers 35 also include a squared upper edge 45 that corresponds in shape to the upper corner 46 of the groove 38. These corresponding shapes keep the washer 36 held within the groove 38 during use such as when the assembly 63 is driven into the ground surface 21. The outer ring 39, the dome-shaped body 40, and the fingers 35 provide a strong resistance to flexing or rolling off the holder 34 after assembly. In particular, because the outer ring 39 extends lower than other elements of the washer 36, the outer ring 39 can partially dig into the ground surface 21 and provide some grip to keep the washer 36 within the groove 38 and on the holder 34. The outer ring 39 may include features such as spikes or a serrated bottom surface that help to facilitate its grip into the ground surface 21. The upward pressure load experienced by the washer 36 as it is hammered into the earth 21 is not enough to overcome the resistance of the washer 36 as a result of these features.

Figure 11:
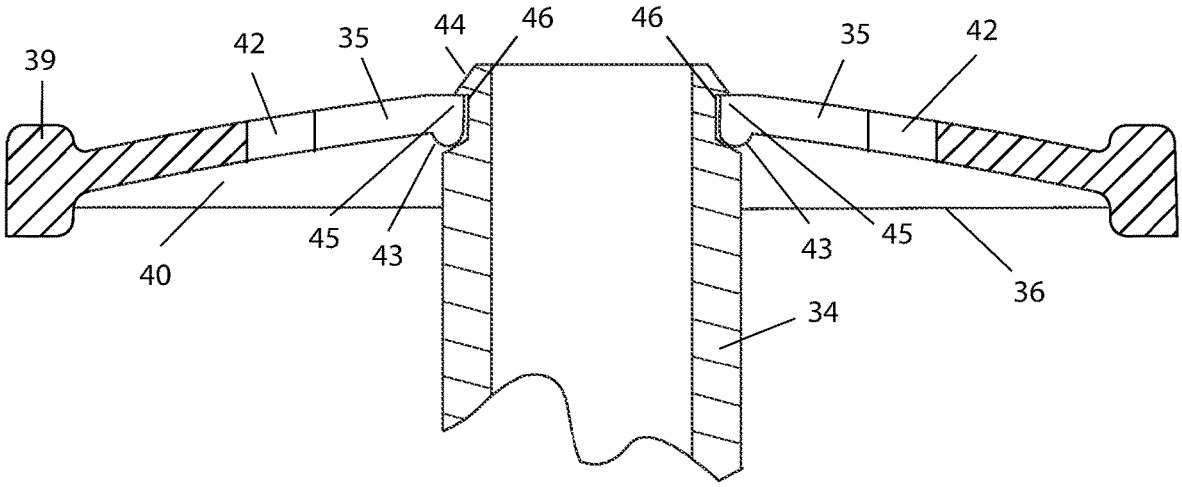
FIG. 11 is a cross-sectional view of the washer-holder assembly of FIG. 8.

FIG. 11 illustrates a completed washer 36 and holder 34 assembly after the fingers 35 have "snapped" into the groove 38.

It is to be understood that the invention may assume various alternative variations and step sequences, except where expressly specified to the contrary. It is also to be understood that the specific devices and processes illustrated in the attached drawings and described in the specification are simply exemplary embodiments or aspects of the invention. Although the invention has been described in detail for the purpose of illustration based on what are currently considered to be the most practical and preferred embodiments or aspects, it is to be understood that such detail is solely for that purpose and that the invention is not limited to the disclosed embodiments or aspects but, on the contrary, is intended to cover modifications and equivalent arrangements that are within the spirit and scope thereof. For example, it is to be understood that the present invention contemplates that to the extent possible, one or more features of any embodiment or aspect can be combined with one or more features of any other embodiment or aspect.

The invention claimed is:

1. A driveway reflector holder and installation tool assembly, comprising:

at least one reflector holder, the reflector holder comprising a hollow sleeve body extending from an upper end to a lower end, a washer disposed proximate to the upper end of the hollow sleeve body, and at least one retention feature disposed on an exterior of the hollow sleeve body; and an installation tool removably receivable within the hollow sleeve body of the at least one reflector holder, the installation tool comprising an elongated body extending from an upper end to a lower end, a head defined at the upper end of the elongated body, and a tapered tip defined at the lower end of the elongated body, wherein the installation tool is configured to extend through the hollow sleeve body of the at least one reflector holder with the head being positioned above the upper end of the hollow sleeve body and the tapered tip being positioned below the lower end of the hollow sleeve body, wherein the installation tool is configured to be driven to insert the at least one reflector holder into a ground surface and configured to be removed from the at least one reflector holder after the at least one reflector holder has been driven into the ground surface, wherein the elongated body of the installation tool comprises a centering surface proximate to the head, the centering surface having a diameter configured to center the installation tool within the hollow sleeve body of the at least one reflector holder, and wherein the at least one reflector holder is configured to removably receive a driveway reflector in the hollow sleeve body after the installation tool is removed.

2. The driveway reflector holder and installation tool assembly of claim 1, wherein the installation tool defines a radiused corner configured to engage the upper end of the hollow sleeve body.

3. The driveway reflector holder and installation tool assembly of claim 2, wherein the radiused corner is located proximate to a bottom surface of the head of the installation tool.

4. The driveway reflector holder and installation tool assembly of claim 2, wherein the centering surface is proximate to the radiused corner.

5. The driveway reflector holder and installation tool assembly of claim 4, wherein the elongated body of the installation tool comprises a blocking surface proximate to the tapered tip, the blocking surface having a diameter corresponding to an inner diameter of the hollow sleeve, whereby the blocking surface is configured to prevent dirt from entering the hollow sleeve.

6. The driveway reflector holder and installation tool assembly of claim 5, wherein the elongated body of the installation tool comprises a relief surface extending from the centering surface to the blocking surface.

7. The driveway reflector holder and installation tool assembly of claim 1, wherein the head of the installation tool comprises a hole configured to receive a removal pin or a removal wire therethrough, the removal pin or the removal wire each being configured to facilitate removal of the installation tool from the at least one reflector holder.

8. The driveway reflector holder and installation tool assembly of claim 1, wherein the hollow sleeve body of the at least one reflector holder comprises a thin-walled extension extending beyond the washer at the upper end, wherein the thin-walled extension is configured to be hammered over the washer and to fasten the washer to the hollow sleeve body upon driving the installation tool and the at least one reflector holder into the ground.

9. The driveway reflector holder and installation tool assembly of claim 1, wherein the hollow sleeve body of the reflector holder comprises at least one circular groove extending about an outer circumference of the hollow sleeve body proximate the upper end, wherein the washer comprises a body defining a central hole corresponding to an outer circumference of the at least one circular groove of the hollow sleeve body, a plurality of slits extending through the body and radially outward from the central hole and defining a plurality of fingers, and a ring extending about an outer circumference of the washer, and wherein the plurality of fingers of the washer are configured to engage with the at least one circular groove of the at least one reflector holder.

10. The driveway reflector holder and installation tool assembly of claim 9, wherein the plurality of slits terminate in a plurality of holes extending through the body of the washer.

11. The driveway reflector holder and installation tool assembly of claim 9, wherein the plurality of fingers comprise rounded lower edges at ends nearest the central hole of the washer body.

12. The driveway reflector holder and installation tool assembly of claim 11, wherein the at least one circular groove is at least partially defined by an upper corner.

13. The driveway reflector holder and installation tool assembly of claim 12, wherein the at least one reflector holder comprises a tapered upper surface opposite the upper corner of the at least one circular groove in the direction of the upper end, the tapered upper surface configured to engage with rounded lower edges of the plurality of fingers when applying the washer to the at least one reflector holder, the plurality of fingers being configured to flex upwardly as the washer is fitted over the tapered upper surface until the plurality of fingers become engaged with the at least one circular groove.

14. The driveway reflector holder and installation tool assembly of claim 13, wherein the plurality of fingers further comprise squared upper edges corresponding to the upper corner of the at least one circular groove, the squared upper edges being configured to at least partially abut the upper corner.

15. The driveway reflector holder and installation tool assembly of claim 9, wherein a lower surface of the ring of the washer is configured to engage with the ground surface upon the installation tool driving the at least one reflector holder into the ground surface.

16. The driveway reflector holder and installation tool assembly of claim 15, wherein the lower surface of the ring of the washer protrudes downwardly with respect to the body of the washer.

17. The driveway reflector holder and installation tool assembly of claim 1, wherein the body of the washer is dome shaped.

18. A driveway reflector holder comprising:

a first end configured to extend at least partially into a ground surface;

a second end, opposite the first end;

a body extending between the first end and the second end, the elongated sleeve defining a hollow sleeve;

at least one retention feature disposed on an outer surface of the body; and a washer extending radially outward from an outer circumference of the body proximate the second end, the washer comprising:

a body defining a central hole corresponding to the outer circumference of the body; and a plurality of slits extending through the body and radially outward from the central hole, the plurality of slits defining a plurality of fingers, wherein the hollow sleeve is configured to removably receive an installation tool therein, and upon installation of the driveway reflector holder, the hollow sleeve is configured to removably receive a driveway reflector therein, wherein the second end is configured to retain the washer about the body.

19. The driveway reflector holder of claim 18, wherein the washer comprises:

a ring extending about an outer circumference of the washer, wherein the plurality of fingers of the washer are configured to engage with at least one circular groove extending about the outer circumference of the body, and wherein the body is dome-shaped.

20. The driveway reflector holder of claim 18, wherein a lower surface of the ring of the washer is adapted to engage with the ground surface and upon engagement, resist displacement forces caused by the ground.

* * * * *